United States Patent [19]

DeDecker

[11] 4,400,031

[45] Aug. 23, 1983

[54] INTERLOCKING CHAIR

[75] Inventor: Edward J. DeDecker, Fountain Valley, Calif.

[73] Assignee: Virco Mfg. Corporation, Los Angeles, Calif.

[21] Appl. No.: 243,046

[22] Filed: Mar. 12, 1981

[51] Int. Cl.[3] ..... A47C 3/04

[52] U.S. Cl. ..... 297/239; 108/91; 248/224.4; 297/248

[58] Field of Search ..... 297/248, 249, 239; 312/111; 46/16, 31; 248/224.4, 222.4, 225.2; 280/33.99 T, 79.2; 220/23.4; 108/64, 91

[56] References Cited

U.S. PATENT DOCUMENTS

| | | | |
|---|---|---|---|
| 1,714,236 | 5/1929 | Peer | 248/224.4 X |
| 3,111,344 | 11/1963 | Hoven et al. | 297/248 X |
| 3,123,399 | 3/1964 | Wilson | 297/248 X |
| 3,133,762 | 5/1964 | Newman | 297/248 X |
| 3,159,425 | 12/1964 | Engstrom | 297/248 |
| 3,237,984 | 3/1966 | Schneider et al. | 297/248 |
| 3,314,718 | 4/1967 | Crandall | 297/248 X |
| 3,328,075 | 6/1967 | Albinson | 297/239 |
| 3,712,668 | 1/1973 | Fink | 297/239 X |
| 3,758,155 | 9/1973 | Straits | 297/248 |
| 4,057,288 | 11/1977 | Schwartz et al. | 297/239 |

FOREIGN PATENT DOCUMENTS

| | | | |
|---|---|---|---|
| 6404996 | 11/1965 | Netherlands | 248/224.4 |

*Primary Examiner*—James T. McCall
*Attorney, Agent, or Firm*—James E. Brunton

[57] ABSTRACT

A stackable utility chair embodying interlocking side bar members which function to releasably interlock together adjacent chairs of identical configuration to form semi-permanent rows. The side bar members also function to positively align the chairs during vertical stacking and, due to their unique Z-shaped cross-sectional configuration, provide substantial lateral stability to the stacked array.

4 Claims, 8 Drawing Figures

FIG. 3.
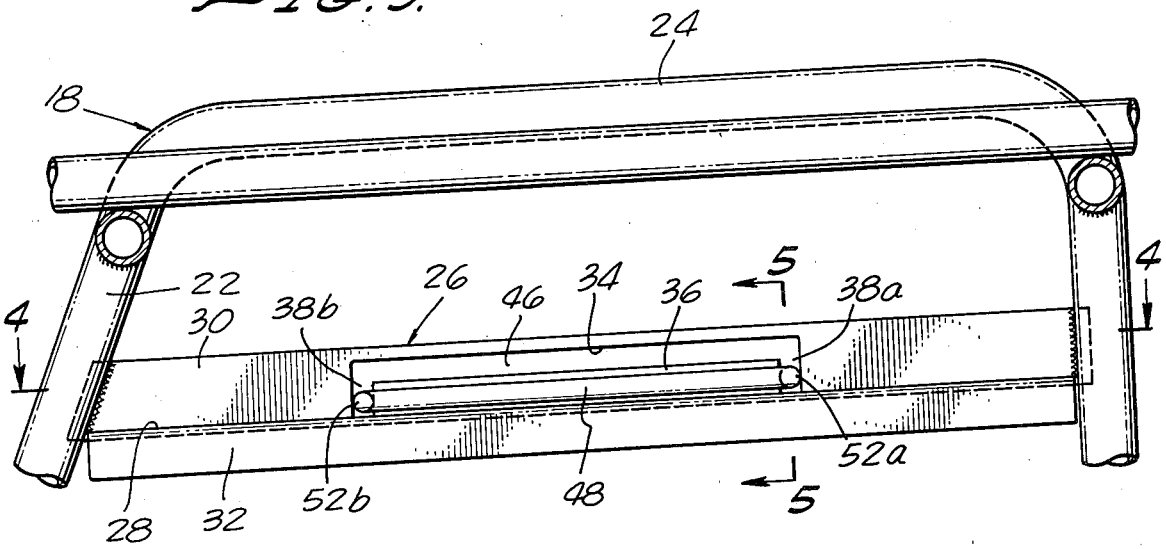
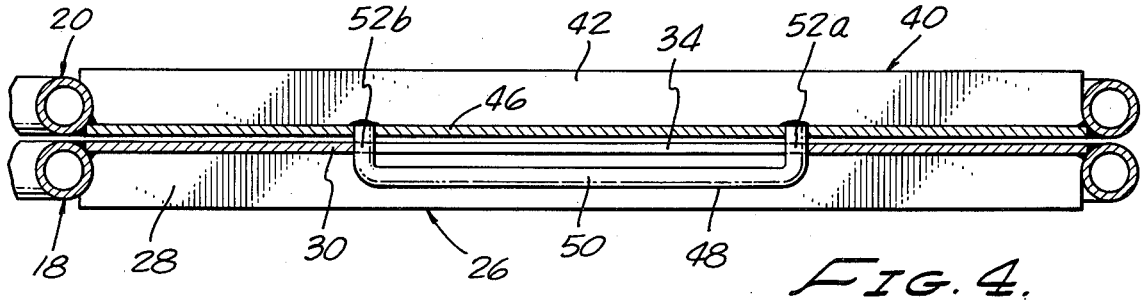
FIG. 4.
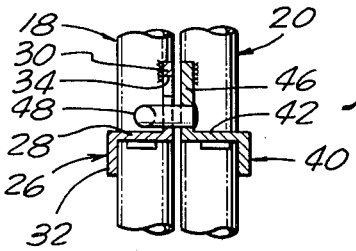
FIG. 5.
FIG. 6.
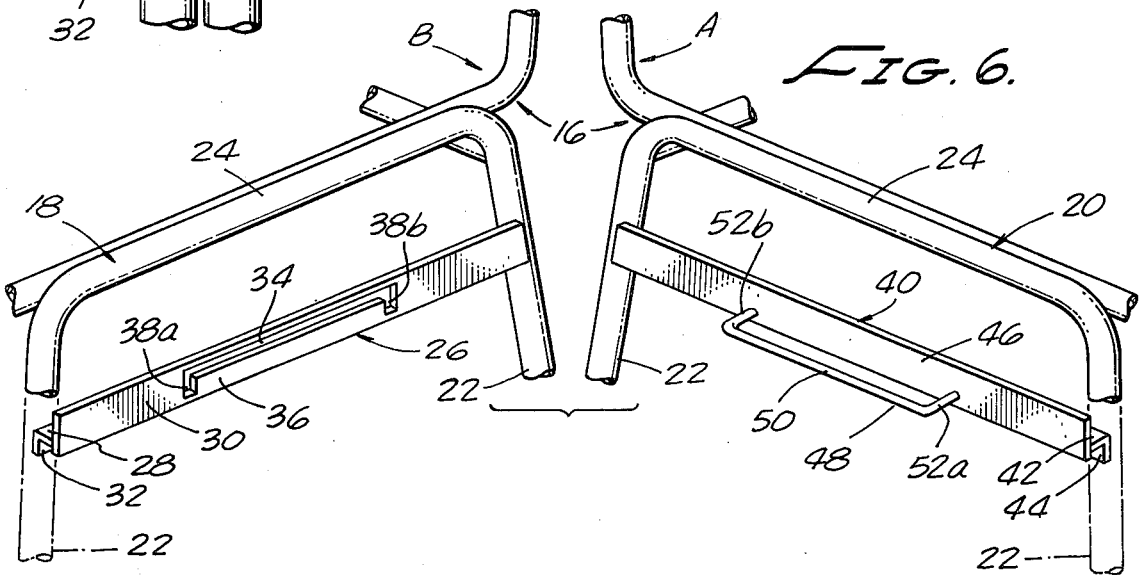

C
D
18
22
30
24
56
26
38a
36
34
32
38b
28
16

INTERLOCKING CHAIR

BACKGROUND OF THE INVENTION

1. Field of the Invention

The present invention relates generally to chair construction. More particularly the invention relates to a chair construction which enables vertical stacking of the chairs into a stable configuration and one which includes a unique interlocking, or ganging, arrangement which permits adjacent chairs to be releasably interlocked together to form semi-permanent rows.

2. Discussion of the Prior Art

In recent years general purpose, or random-utility chairs have become quite popular for use in large indoor arenas and the like. By using removable chairs, rather than fixed in place theater type seating, arenas and pavilions can be used for a wide variety of purposes. For example, using removable utility chairs, a ballroom, gymnasium, or sports arena floor can be quickly converted to an auditorium capable of seating hundreds of people.

However, the use of removable utility chairs in the manner described is not without problems. In the first place, storage of the chairs when they are not in use has created difficulties. In attempting to alleviate this problem several chair manufacturers have suggested designs which enable the chairs to be stacked vertically one on top of the other. Such a feature conserves space and expedites moving of the chairs between the storage area and the arena. However, most such designs fail to consider the problem of lateral stability so that when the chairs are in a stacked configuration they are extremely unstable and tend to topple. This situation creates an obvious and highly undesirable safety problem.

Another very serious problem inherent in the use of random utility chairs for auditorium applications concerns the tendency of the chairs to become disarrayed. Good safety practices dictate that in auditorium type seating aisleways be kept open at all times for ingress and egress. In practice, even though the chairs may be set up in rows initially, if they are free to slide about, aisleways quickly disappear as the people move into the auditorium and adjust their seating position. In an emergency situation the problem is substantially aggravated as the chairs are pushed about by the people trying to reach the auditorium exits.

The chairs of the present invention effectively overcome the problems set forth in the previous paragraphs. Through the use of uniquely designed side bar interlocking members, adjacent chairs can be quickly and easily interlocked together to form semipermanent rows for safe auditorium seating. These novel interlocking members also function to expedite vertical stacking of the chairs and, due to their unique design, provide substantial laterial stability to the stacked array. Additionally, the strategic positioning of plastic bumpers on the interlocking members prevent marring of the chair frames during the stacking and transport operations.

SUMMARY OF THE INVENTION

It is an object of the present invention to provide a unique chair design in which adjacent chairs can be quickly and easily interlocked together to form semi-permanent rows.

It is another object of the invention to provide a chair design of the aforementioned character in which each chair is provided with a male and a female interlocking side bar member which cooperates with the interlocking members on adjacent chairs to provide a positive locking arrangement. The design of the interlocking member is such that accidental separation of the interlocked chairs is effectively prevented.

It is another object of the invention to provide a chair design of the character described in which the side bar members also function to align the chairs during vertical stacking and at the same time serve to lend substantial lateral stability to the stacked array.

It is still another object of the invention to provide a chair design of the type described in the previous paragraphs in which plastic or rubber bumbers are strategically positioned to prevent damage to the chair frames during stacking and transport.

It is a further object of the invention to provide a chair design of the character described in which the interlocking members are of simple design and can be effeciently and inexpensively mass produced.

BRIEF DESCRIPTION OF THE DRAWINGS

FIG. 3 is a cross-sectional view taken along lines 3—3 of FIG. 2 showing the appearance of the apertured female interlocking side bar with the interlocking portion of the male side bar disposed in a locked position.

FIG. 4 is a cross-sectional view taken along lines 4—4 of FIG. 3 illustrating the generally U-shaped configuration of the interlocking portion of the male interlocking side bar.

FIG. 5 is a cross-sectional view taken along lines 5—5 of FIG. 3 further illustrating the interlocking mechanism.

FIG. 6 is a generally perspective view showing adjacent chairs in a spaced apart configuration with the male side bar on the right hand chair and the female side bar on the left hand chair.

DESCRIPTION OF ONE EMBODIMENT OF THE INVENTION

Figure 1:
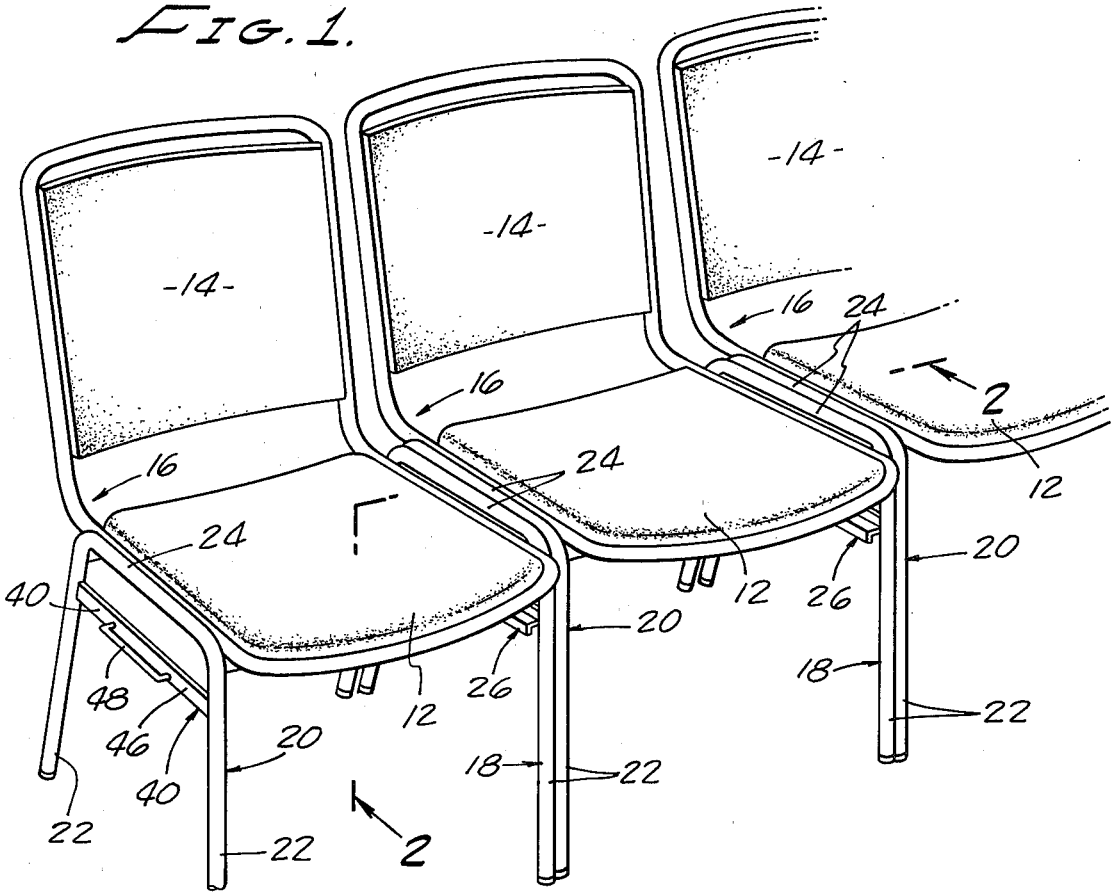
FIG. 1 is a generally perspective view showing adjacent chairs of identical design releasably interlocked, or ganged, together to form a semi-permanent row.
Figure 2:
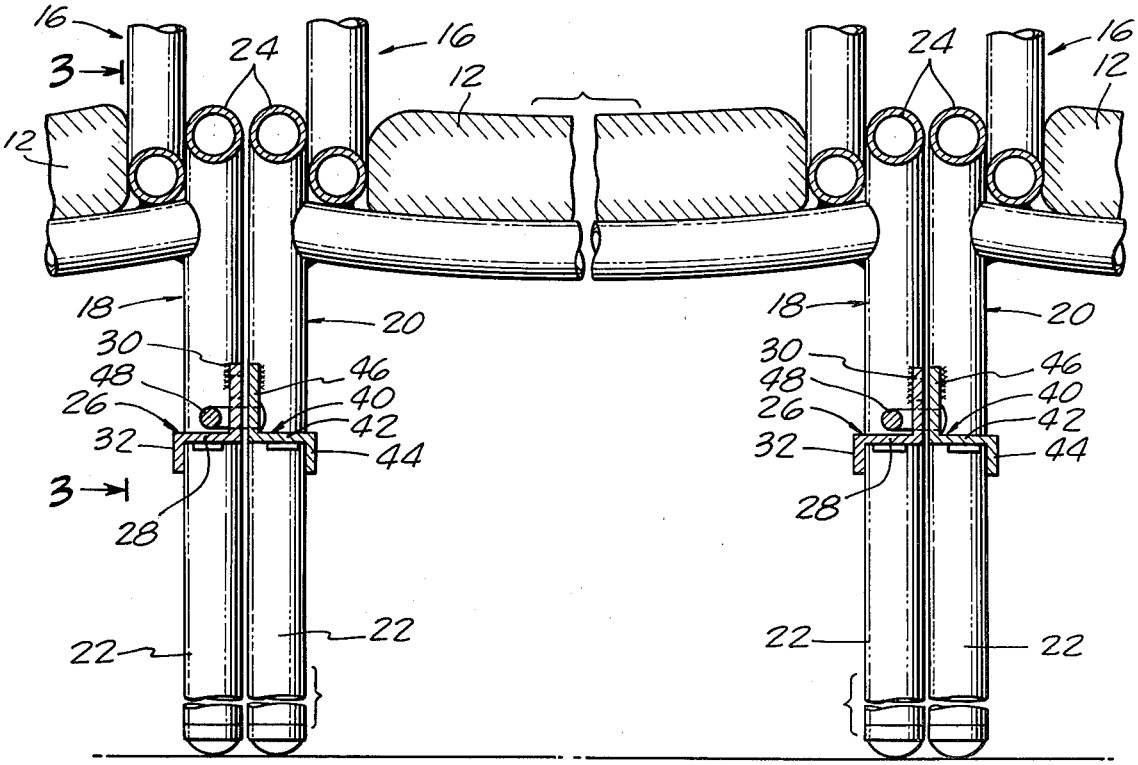
FIG. 2 is a cross-sectional view taken along lines 2—2 of FIG. 1 illustrating the Z-shaped cross-sectional configuration of the male and female interlocking side bar members.

Referring to the drawings, and particularly to FIGS. 1 through 4, the chair construction of the present invention comprises a seat portion 12, a back rest portion 14 and a supporting frame generally designated by the numeral 16. The seating frame 16, which functions to position the back rest and seat portions, includes first and second generally U-shaped frame members 18 and 20 disposed on opposite sides of seat portion 12 of the chair. Each U-shaped frame member has a pair of downwardly extending spaced apart leg members 22 which are interconnected by an upper bight portion 24.

As best seen by referring particularly to FIGS. 1 and 3, leg portions 22 of the U-shaped frame member 18 and 20 slope downwardly and outwardly to facilitate stacking of the chairs in a manner presently to be described.

An important feature of the present invention is the provision of interlocking means on each of the U-shaped frame members 18 and 20 for releasably interconnecting together adjacent, identically configured chairs. In the embodiment of the invention shown in the drawings, these interlocking means comprise a first interlocking means provided in the form of a female side bar interlocking member 26 interconnecting the leg members of the first U-shaped frame member 18. As best seen by referring to FIGS. 2 and 6, this female side bar member 26 is substantially Z-shaped in cross-section and has a central planar section 28 disposed in a substantially horizontal plane. Interconnected with central planar section 28 at each margin thereof are first and second vertically extending planar sections 30 and 32. Referring particularly to FIG. 6, it can be seen that the first vertically extending planar section 30 is provided with an elongated aperture 34 having a substantially horizontally extending central portion 36 and downwardly depending spaced apart end portions 38*a* and 38*b*.

In the present form of the invention the interlocking means also comprises a second interlocking member provided in the form of a male side bar 40 (FIG. 6) which interconnects legs 22 and U-shaped frame member 20. This male side bar interlocking member 40 is of similar construction to female side bar member 26 being Z-shaped in cross-section and including a central planar section 42 disposed in a substantially horizontal plane. Member 40 also comprises first and second vertically extending planar sections 44 and 46 respectively which are interconnected with central planar section 42 proximate the edges thereof. However, in the case of this member vertically extending planar section 46 is not provided with a U-shaped aperture, but rather is provided with an outwardly extending locking element 48 which is adapted to be closely received within an aperture of the configuration exemplified by aperture 34 which is formed in the female side bar member 26. In planar view, element 48 is generally U-shaped in configuration having a central bight portion 50 which is slightly shorter in length than the central portion 36 of aperture 34 and includes end or leg portions 52*a* and 62*b* which have a width slightly less than the width of the end portions 38*a* and 38*b* of the aperture 34.

As illustrated in FIGS. 1, 3 and 5, the first interlocking means, or female side bar member, 26 is adapted to be releasably interlocked together with a second interlocking means, or male side bar member, 40 provided on an adjacent identically configured chair disposed side by side with first U-shaped frame member.

When it is desired to releasably interconnect, or gang, together two chairs of the invention, the chair designated by the letter "A" in FIG. 6 is elevated slightly with respect to the chair designated "B" so that the bight portion 50 of the U-shaped locking element 48 can be inserted into the horizontally extending portion 36 of aperture 34. Once the bight portion 50 has been extended through the central portion of the aperture, chair "A" is lowered to the same height as chair "B". In lowering the chair, the end portions 52*a* and 52*b* of the locking element are closely received in the end portions 38*a* and 38*b* of the aperture 34. In this interlocking configuration, it is apparent that the chairs "A" and "B" cannot be separated unless and until chair "A" is once again elevated slightly with respect to chair "B" so that the locking element 48 can be withdrawn through the aperture 34. With this construction chairs "A" and "B" are held rigidly together in an interlocking aligned position and cannot be accidently or inadvertently separated. In point of fact, to separate the chairs the overt act of elevating chair "A" with respect to chair "B" followed by a lateral displacement of the chairs is required.

It is apparent that any number of identical chairs can be interconnected or ganged together in the manner described. This is true because each chair of the invention is provided on one side with a male interlocking side bar member and its opposite side with a female interlocking side bar member. By simply interlocking the chairs together in the manner described in the previous paragraphs, a large number of chairs can be ganged together to form neat, rigid, semi-permanent rows.

Figure 7:
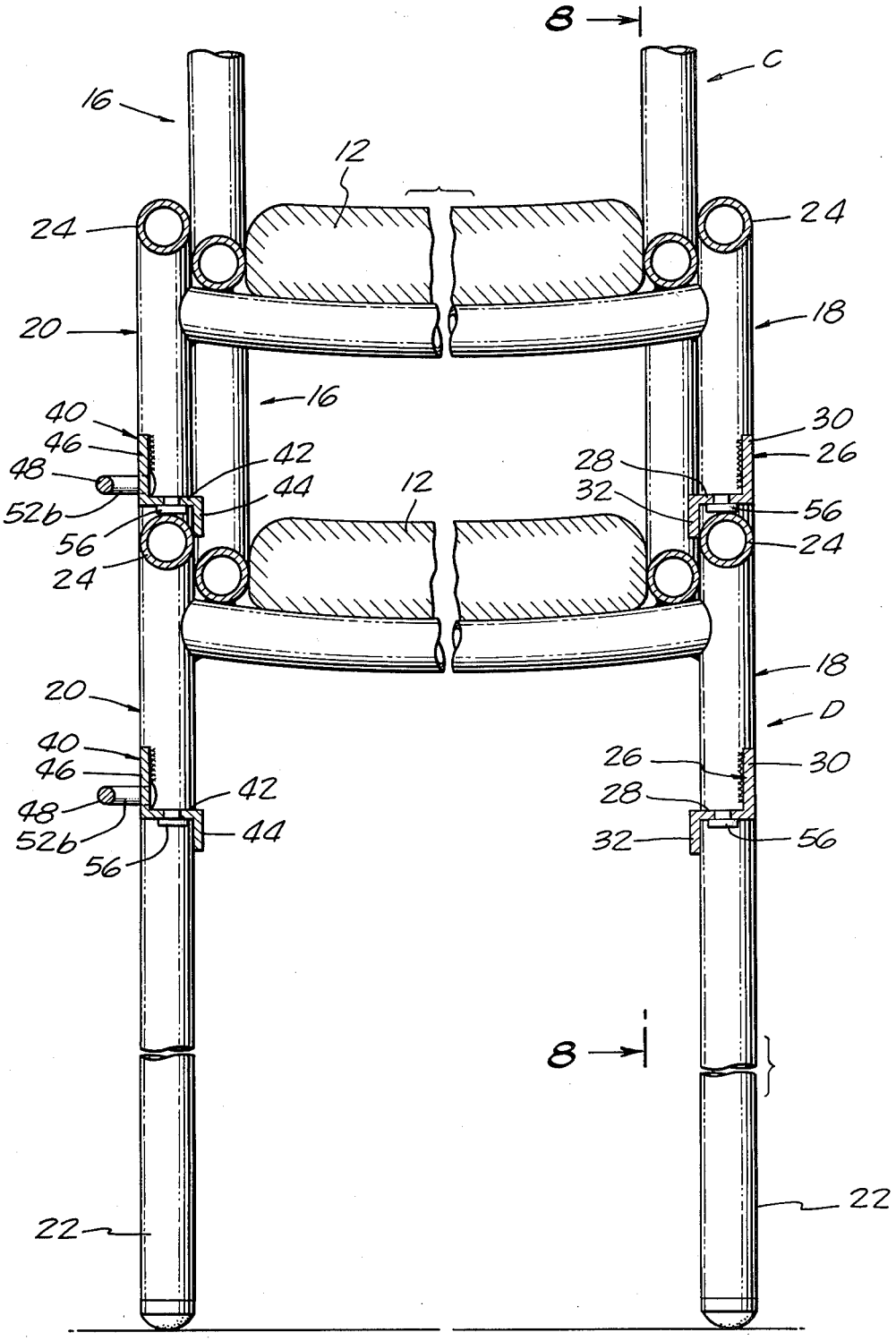
FIG. 7 is a vertical cross-section taken through two chairs which are in a vertically stacked relationship.
Figure 8:
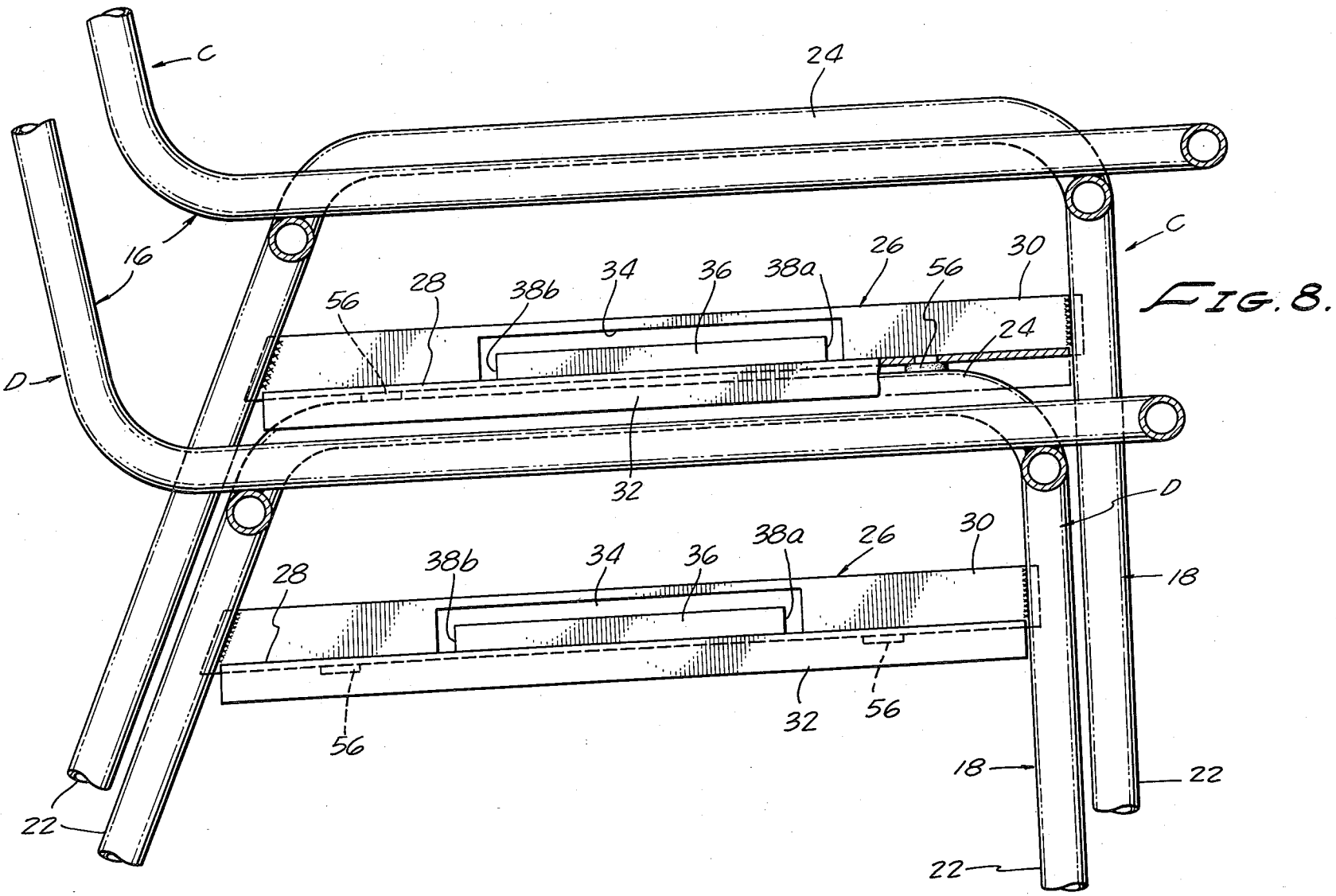
FIG. 8 is a cross-sectional view taken along lines 8—8 of FIG. 7 illustrating the manner in which the Z-shaped interlocking side bars function to provide alignment and lateral stability to the stacked array.

Referring now to FIGS. 7 and 8 there is illustrated a second important aspect of the present invention, namely the ability of the chairs to be vertically stacked, one on top of each other. Turning particularly to FIG. 7, it can be seen that in the stacked configuration the interlocking side bar members 26 and 40 of the invention perform a second important function, namely that of aligning the chairs and providing lateral stability to the stacked array.

Referring to FIGS. 7 and 8 wherein the top chair is designated by the letter "C" and the bottom chair is designated by the letter "D", it can be seen that at the left side of the stacked configuration the central section 42 of the male sidebar member 40 of chair "C" rests upon the bight portion 24 of the U-shaped frame member 20 of chair "D". Similarly, on the right side of the stacked configuration, the central section 28 of the female interlocking member, or side bar, 26 rests upon the bight portion 24 of the U-shaped framework 18 of chair "D". As best seen in FIG. 7, with this construction, vertically extending planar sections 32 and 44 of the female and male side bar members respectively engage the inner surfaces of the bight portions 24 of the U-shaped frame members 18 and 20 of chair "D". This engagement by the downward depending vertical planar sections 32 and 44 precisely aligns the chairs in the stacking relationship and in the same time provides lateral stability effective to resist accidental toppling of the array.

As also shown in FIGS. 7 and 8, a pair of plastic bumper elements 56 are affixed to the bottom surfaces of each horizontally extending planar section of the male and female interlocking side bar members. These plastic bumpers 56 function to prevent scratching or maring of the frame members of the chairs during stacking or transport operations.

Although the drawings show only two chairs stacked together, it will be appreciated that several chairs can be stacked together in the manner described for storage and transport.

Having now described the invention in detail in accordance with the requirements of the patent statues, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. In a chair construction of the type having a seat portion and a backrest portion and also having a supporting frame, including first and second generally U-shaped frame members disposed on opposite sides of the seat portion, each said frame member having a pair of downwardly extending spaced apart leg members interconnected by a bight portion, the improvement comprising:

(a) first interlocking means adapted to be releasably interlocked together with a second interlocking means provided on an adjacent identically configured chair disposed proximate the first U-shaped frame member, said first interlocking means comprising a female side bar member, substantially Z-shaped in cross-section, interconnecting the leg members of the first U-shaped frame member and including generally vertically disposed first planar section having an elongated aperture provided therein including an interconnected substantially horizontally extending central portion and an interconnected second downwardly depending generally vertically disposed planar section spaced apart from said first planar section; and (b) second interlocking means adapted to be releasably interlocked together with a first interlocking means provided on an adjacent identical chair disposed proximate the second U-shaped frame members, said second interlocking means comprising a male side bar member, substantially Z-shaped in cross-section, interconnecting the leg members of the second U-shaped frame member and including a substantially horizontally extending central portion and a generally vertically disposed spaced apart first and second planar sections, said first planar section having an outwardly extending locking element including a central section adapted to be closely received within the central portion of the aperture provided in the female side bar member of an adjacent chair and including end portions adapted to be closely received in the end portions of the aperture provided in said female side bar member, said male and female side bar members of a first chair being adapted to engage the bight portions of said first and second U-shaped frame members of a second identically configured chair when said first and second chairs are vertically stacked one on top of another with said second planar sections being adapted to engage a portion of the bight portions of said first and second U-shaped frame members of said second chair.

2. In a chair construction as defined in claim 1 in which at least one plastic bumper element is affixed to said central planar section of each of said male and female side bar members for interengagement with the bight portions of said U-shaped frame members.

3. In a chair construction of the type having a seat portion and a backrest portion and also having a supporting frame including first and second generally U-shaped frame members disposed on opposite sides of the seat portion, each said frame member having a pair of downwardly extending spaced apart leg members interconnected by a bight portion, the improvement comprising:

(a) a first substantially horizontally extending interlocking member disposed below the bight portion and interconnecting the leg members of said first generally U-shaped frame member, said first interlocking member being substantially Z-shaped in cross-section having a central planar section disposed in a substantially horizontal plane, and first and second vertically extending planar sections interconnected with said central planar sections proximate the edges thereof, said first vertically extending planar section being provided with an elongated aperture having a substantially horizontally extending central portion and downwardly depending spaced apart end portions; and (b) a second substantially horizontally extending interlocking member disposed below the bight portion and interconnecting the leg members of said second generally U-shaped frame member, said second interlocking member being substantially Z-shaped in cross-section having a planar section disposed in a substantially horizontal plane and said first and second generally vertically extending planar sections interconnected with said central planar section proximate the edges thereof, said first vertically extending planar section being provided with an outwardly extending generally U-shaped locking element including a central bight portion having a length slightly less than the length of the central portion of the aperture of said first planar section of said first interlocking member and including leg portions having a width slightly less than the width of the end portions of the aforementioned apertures.

4. In a chair construction as defined in claim 3 in which said central planar section and said second vertically extending planar section of each of said interlocking members of a first chair are adapted to engage the bight portions of the first and second U-shaped frame members of a second identically configured chair when said first and second chairs are vertically stacked one on top of the other.

* * * * *